US010538382B2

(12) United States Patent
Petzitillo, Jr.

(10) Patent No.: US 10,538,382 B2
(45) Date of Patent: Jan. 21, 2020

(54) INTERMODAL CONTAINER HAVING FLARED SIDEWALLS

(71) Applicant: Wastequip LLC, Charlotte, NC (US)

(72) Inventor: Anthony Daniel Petzitillo, Jr., Sicklerville, NJ (US)

(73) Assignee: Wastequip LLC, Charlotte, NC (US)

( * ) Notice: Subject to any disclaimer, the term of this patent is extended or adjusted under 35 U.S.C. 154(b) by 82 days.

(21) Appl. No.: 15/725,831

(22) Filed: Oct. 5, 2017

(65) Prior Publication Data

US 2019/0106276 A1 Apr. 11, 2019

(51) Int. Cl.

| | |
|---|---|
| ***B65D 90/02*** | (2019.01) |
| ***B65D 90/00*** | (2006.01) |
| ***B65D 88/12*** | (2006.01) |
| ***B65D 88/02*** | (2006.01) |

(52) U.S. Cl.

CPC ..... *B65D 90/02* (2013.01); *B65D 88/022* (2013.01); *B65D 88/121* (2013.01); *B65D 90/008* (2013.01); *B65D 90/0026* (2013.01)

(58) Field of Classification Search

USPC ..... 220/1.5, 4.26, 378, 810, 826, 908, 849, 220/813; 414/425, 404, 405, 812, 45; 222/181.1, 180, 624, 625, 630, 652; 406/41, 119; 410/45; 206/504; 232/43.4; 217/36, 17

See application file for complete search history.

(56) References Cited

U.S. PATENT DOCUMENTS

| | | | | |
|---|---|---|---|---|
| 1,627,336 | A | 5/1927 | Nelson | |
| 1,989,125 | A | 1/1935 | Atwell | |
| 2,974,997 | A * | 3/1961 | Grant | B60H 1/00014 296/182.1 |
| 5,090,773 | A | 2/1992 | Guillaume | |
| 5,460,431 | A | 10/1995 | McWilliams | |
| 6,364,154 | B2 | 4/2002 | Kruzick et al. | |
| 6,413,036 | B2 | 7/2002 | Welton | |
| 6,796,452 | B2 | 9/2004 | Petzitillo, Jr. et al. | |
| 7,240,936 | B2 | 7/2007 | Petzitillo, Jr. et al. | |
| 7,306,110 | B2 | 12/2007 | Petzitillo | |
| 7,789,256 | B2 * | 9/2010 | Petzitillo, Jr. | B65D 88/126 206/501 |
| 8,746,805 | B1 | 6/2014 | Petzitillo, Jr. et al. | |

(Continued)

*Primary Examiner* — J. Gregory Pickett
*Assistant Examiner* — Tia Cox
(74) *Attorney, Agent, or Firm* — Nelson Mullins Riley & Scarborough LLP

(57) ABSTRACT

A transport container is provided including a frame including a front frame and a rear frame, each including two vertical corner posts interconnected by lower and upper crossmembers. The frame also includes a set of lower rails and a set of upper rails extending between the front and rear frames defining upper and lower longitudinal corner edges of the container. The transport container also includes a body comprising a plurality of container walls defining a cargo receiving space, each of the container walls being supported by the frame. The plurality of container walls includes a bottom, first and second longitudinal walls, and first and second end walls. The first longitudinal wall and the second longitudinal wall are flared, such that distance between the first longitudinal wall the second longitudinal wall is widest proximate to an opening disposed at the first end wall.

18 Claims, 4 Drawing Sheets

(56) References Cited

U.S. PATENT DOCUMENTS

| | | | | |
|---|---|---|---|---|
| 9,039,097 | B2 | 5/2015 | Petzitillo, Jr. et al. | |
| 9,669,748 | B2 | 6/2017 | Petzitillo, Jr. et al. | |
| 9,988,099 | B2 * | 6/2018 | Hagenbuch | B60P 1/286 |
| 2007/0238166 | A1 * | 10/2007 | McNelly | B65D 88/121 435/290.1 |
| 2016/0114968 | A1 * | 4/2016 | Miled | B65D 88/005 220/1.5 |
| 2018/0065798 | A1 * | 3/2018 | Numa-Beaujour | B65D 88/121 |

* cited by examiner

INTERMODAL CONTAINER HAVING FLARED SIDEWALLS

TECHNICAL FIELD

Example embodiments generally relate to intermodal containers and, in particular, relate to an intermodal container with flared walls.

BACKGROUND

Intermodal containers can be used in general to hold and ship various materials, including bulk materials, and can be useful as transport containers for waste material. A primary advantage of intermodal containers is the use of connector fittings at standard spacings, typically at each of the eight corners of a rectangular container or box in one of several standard sizes. The connector fittings enable the intermodal container to be affixed to mountings placed at the same standard spacings on movable chassis configurations appropriate for road, rail, sea or other transport, for stacking and the like. Likewise, the containers can be manipulated using lifts and spreader frames having grappling devices at the standard spacings.

Intermodal containers are used in various standard sizes. A typical standard container is a substantially rectilinear box and may measure twenty or forty feet in length, from four to twelve feet high and eight feet to eight feet six inches laterally. The typical container is made using steel plate, optionally with channel-like corrugations, and may comprise reinforcing and framing parts comprising rectangular tubing, angle iron, and bar stock.

SUMMARY

Some example embodiments may comprise a transport container with flared longitudinal walls to reduce friction between a transported material and the longitudinal walls as the material carried in the container is dumped and slides out of the container. The reduction in friction may reduce erosion on the container walls and extend the life of the container.

In an example embodiment, a transport container is provided including a frame including a front frame and a rear frame, each of the front frame and rear frame including two vertical corner posts interconnected by a lower crossmember and an upper crossmember. The frame also includes a set of lower rails and a set of upper rails extending between the front frame and the rear frame defining upper and lower longitudinal corner edges of the container. The transport container also includes a body comprising a plurality of container walls defining a cargo receiving space, each of the container walls being supported by the frame. The plurality of container walls includes a bottom, a first longitudinal wall, a second longitudinal wall, a first end wall, and a second end wall. The first longitudinal wall and the second longitudinal wall are flared, such that distance between the first longitudinal wall the second longitudinal wall is widest proximate to an opening disposed at the first end wall.

In another example embodiment, an intermodal transport container is provided including a frame including a rectangular front frame and a rectangular rear frame, each of the front frame and rear frame including two vertical corner posts interconnected by a lower crossmember and an upper crossmember. The frame also includes a set of lower rails and a set of upper rails extending between the front frame and the rear frame defining upper and lower longitudinal corner edges of the container. The intermodal transport container also includes a body comprising a plurality of container walls defining a cargo receiving space, each of the container walls being supported by the frame. The plurality of container walls includes a bottom, a first longitudinal wall, a second longitudinal wall, a first end wall, and a second end wall. A first distance between the first longitudinal wall and the second longitudinal wall proximate to the first end wall is greater than the a second distance between the first longitudinal wall and the second longitudinal wall proximate to the second end wall. The intermodal transport container also includes intermodal fittings disposed at each corner of the container.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
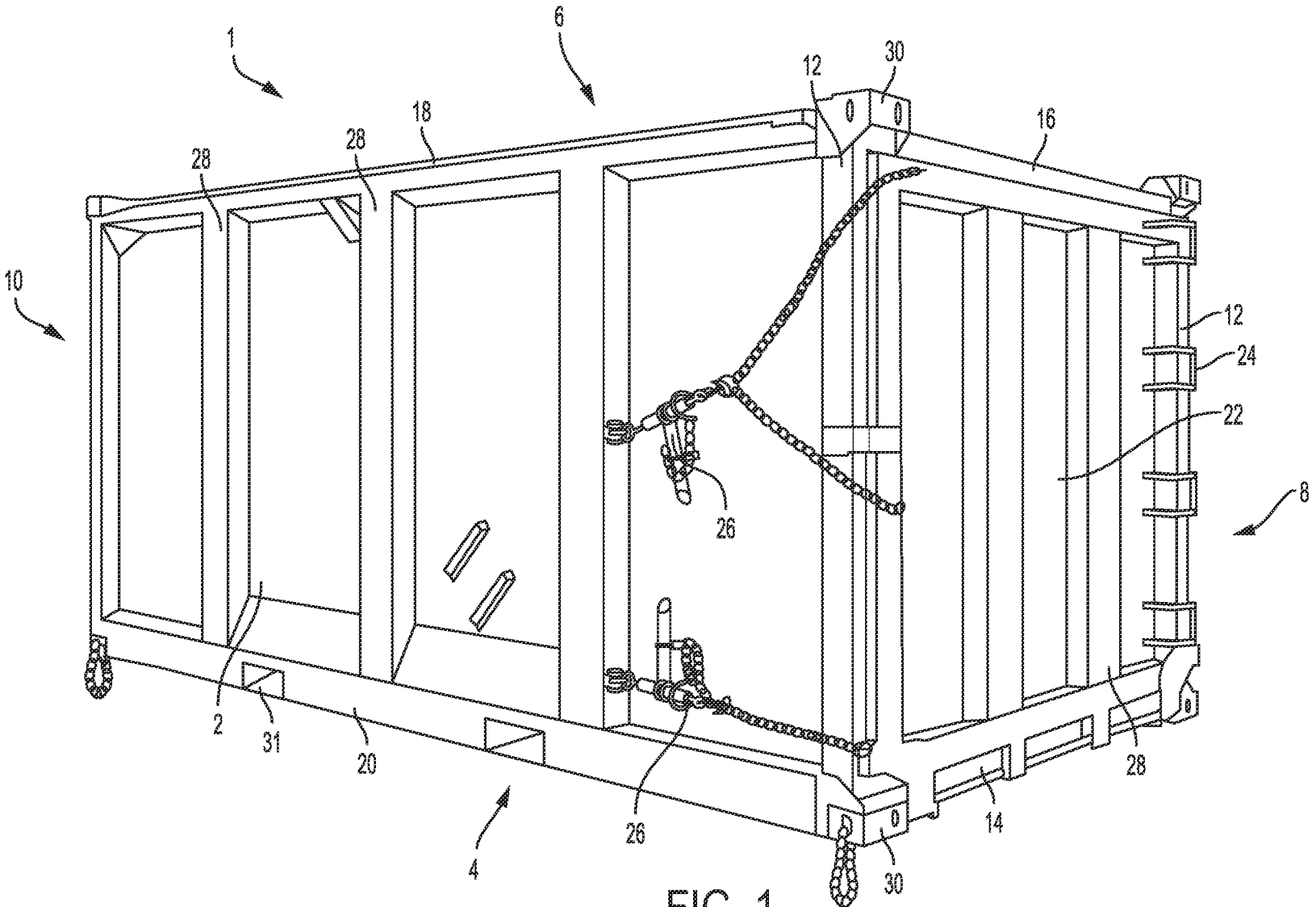
FIG. 1 is a perspective view of a container including intermodal container standardized fittings.

Reference will now be made in detail to various embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As used herein, terms referring to a direction or a position relative to the orientation of the container, such as but not limited to "vertical," "horizontal," "upper," "lower," "front," or "rear," refer to directions and relative positions with respect to the container's orientation in its normal intended operation, as indicated in the Figures herein. Thus, for instance, the terms "vertical" and "upper" refer to the vertical direction and relative upper position in the perspectives of the Figures and should be understood in that context, even with respect to an apparatus that may be disposed in a different orientation.

Some materials, such as fly ash or coal ash, may be highly caustic and abrasive. After such material is loaded into a container, the material tends to laterally expand and apply pressure to the container sidewalls as the material settles during transportation. During dumping, as the abrasive material slides out of the container, the material may rub against the sidewalls, causing erosion thereof. In addition to erosion of the side walls, corrosion may occur on the container sidewalls at the tideline, e.g., where the material in the container meets the airspace above the material. The erosion may remove protective paint from the sidewalls and accelerate corrosion caused by the material.

As indicated above, some example embodiments relate to a container having flared longitudinal walls to limit or prevent erosion and/or corrosion of the sidewalls of the container. In an example embodiment, the sidewalls of the container may be formed of a corrosion resistant metal, such as COR-TEN A steel or ASTM A606 Type 4 steel, further reducing corrosive effects of the transported material.

In some embodiments, the longitudinal walls of the container may be flared such that the container body tapers from a front opening toward a rear of the container. The taper in the container body may allow material carried therein to release from the longitudinal walls as the material begins to slide out of the container due to the longitudinal walls being farther apart as the proximity to the front opening increases. The tapered container body may limit or eliminate the potential of the expanding material to rub the sidewalls of the container while being dumped, thereby reducing erosion and/or corrosion of the container. The reduction in the erosion and corrosion may substantially increase the life of the container, especially in instances in which corrosive materials are being transported.

Unlike other transport containers, intermodal containers are constructed to be compliant with international standards organization (ISO) standard 668, e.g., ISO 668 Series 1 freight containers—Classification, dimensions and ratings as published in August 2013. As such, containers are generally built as rectilinear boxes within the allowances of ISO 668. Advantageously, embodiments of the transport container described herein meet the ISO 668 standard for both external and interior dimensions while also comprising flared longitudinal walls. In some preferred embodiments, the frame maintains a generally rectilinear construction (e.g., the frame may have a rectangular profile in plan, as well as side and end elevations) allowing the intermodal fittings to maintain the specified spacing enabling stacking, mounting, and transport. However, the container body may be constructed to taper from the front opening to the rear end wall within the interior dimension requirements of ISO 668.

As noted above, embodiments of the present invention may comprise intermodal-type bulk containers for solid waste transfer. Certain aspects of the construction of intermodal-type bulk containers are described with reference to FIG. 1 which shows an intermodal container 1. Container 1 is generally shaped as rectilinear box having a container body defined by a plurality of container walls alone, or in some cases, in conjunction with one or more frame elements, described in more detail below. The container walls may include at least longitudinal side walls 2, a bottom wall 4, a top wall 6, a first end wall 8, and a second end wall 10. The container body may define an interior cargo receiving space. Container 1 may include one or more loading or discharge openings (depicted in the embodiment shown in FIG. 3), which may be disposed in any suitable container wall. In an example embodiment, one of the end walls, such as second end wall 10, may be removable or openable to provide for loading and/or discharge of material into and out of container 1. In some example embodiments, container 1 may also include a top opening with a removable lid (depicted in the embodiment shown in FIG. 2). As would be immediately understood by one of skill in the art, materials may be loaded and/or unloaded through any opening provided in the container walls.

The container walls may be formed from steel, steel alloy, or another suitable metal material and may be corrosion resistant. As noted above, in some embodiments the container walls may be formed of COR-TEN A steel or A606-4 steel. Additionally or in the alternative, the container walls may include one or more protective coatings, such as paint, powder coating, plastic, rubber, or other suitable coatings. The corrosion resistant container walls and/or protective coatings may reduce corrosion of the container walls due to general or pitting corrosion, oxidation, or chemical reaction with corrosive materials being transported. In some embodiments, some or all of the interior and/or exterior surfaces of the container may be coated or primed with a corrosion-resistant and low-coefficient of friction coating. For instance, in some embodiments, coatings offered by the Valspar Corporation of Minneapolis, Minn., such as the Pipeclad® Flowliner coating, may be suitable.

The frame includes a front frame, or front stacking frame, which may preferably be generally rectangular in shape. The front frame has a pair of vertical corner posts 12 interconnected at opposing ends by a lower crossmember 14 and upper crossmember 16. The frame also includes a rear frame, or rear stacking frame, which may also be generally rectangular in shape. The rear frame has vertical corner posts, a lower crossmember, and upper crossmember substantially similar to the front frame. Two upper rails 18 and two lower rails 20 may be provided at the lower and upper longitudinal corner edges of container 1, respectively. Upper rails 18 and lower rails 20 may extend between the front frame and rear frame. The various elements of the frame may be circular, square, or rectangular tubes formed of steel, steel alloys, or other suitable material to provide lateral and vertical support for container 1 during various loading, unloading, craning, and transport operations and to resist corrosion caused by the environment and/or materials being transported. Further, the various elements of the frame may be joined by welding or other suitable method.

Container 1 may also include one or more side rail posts 28 extending between upper rails 18 and lower rails 20. Side rail posts 28 may provide vertical support between upper rails 18 and lower rails 20, as well as lateral support for longitudinal walls 2. Additionally, side rail posts 28 may be provided between lower crossmember 14 and upper crossmember 16 and/or swing door 22.

The respective corners of container 1, as depicted, may be outfitted with standard intermodal fittings 30 that are spaced and configured for use with different types of handling equipment. Intermodal fittings 30 may enable container 1 to be secured for transport, stacking, craning, or the like, as known to those of skill in the art. In some embodiments, the intermodal fittings may be disposed at positions along upper rails 18 and/or lower rails 20 other than the corners to facilitate fitting layouts that do not match the fitting layout of the corners of container 1, such as different size containers, or transports configured for other size containers.

In the depicted embodiment, first end wall 8 includes a swing door 22, or loading door, mounted to the front frame, which is shown in a shut position in the depicted example. Swing door 22 is sized to fit the loading opening in the front frame. Particularly, swing door 22 is mounted to one of the vertical corner posts 12 by hinges 24. Hinges 24 may be heavy gauge steel hinges or other suitable hinges configured to support the weight of swing door 22. Swing door 22 is hinged relative to the vertical corner post 12 by hinge 24 and is movable to occupy the loading opening by hinging around the axis of one or more hinges 24. One of skill in the art would immediately appreciate that swing door 22 is merely provided as an example and other doors may be substituted, such as double swing doors, a roll up door, or the like. Additionally, in some embodiments, both end walls 8 and 10 of container 1 may comprise a door.

A compressible sealing gasket may be carried by either swing door 22 or the front frame. The gasket can be a solid or celled rubber or polymer material as known in the art. The gasket is compressed between swing door 22 and the front frame when the door is closed and sealed. In an example embodiment in which container 1 is a rather heavy duty apparatus, the seal may be stiff, durable and requires substantial force to compress to the operative sealing pressure needed when the container closure is sealed, i.e., when swing door 22 occupies the loading opening in first end wall 10.

Swing door 22 may have one or more closure mechanisms 26 for urging the swing door 22 against the front frame to compress the gasket. In the illustrated embodiment, for example, closure mechanism 26 may include one or more chains or cables affixed to the swing door 22 and a turnbuckle. The turnbuckle may be affixed to longitudinal side wall 2 or vertical corner post 12 at a first end and include a hook at a second end, which may engage the chains or cables. The turnbuckle may be tightened by operation of a handle or ratchet, which in turn may cause the chains to apply force against swing door 22 compressing the sealing gasket.

In another example embodiment, along the edge of swing door 22 opposite from the hinges 24 closure mechanism 26 may include a cam-engaging clamping rod operated by a lever handle that can be pivoted up from the plane of the swing door around an axis parallel to clamp rod. The clamping rod is mounted on the surface of the front frame at the corresponding non-hinged vertical corner post 12 and presents tabs for engagement with raised structural members of swing door 22. Rotation of clamping rod advances or retracts the tabs, which comprise flaps or projections welded on the clamping rod at spaced intervals. The clamping rod is rotatably supported on a vertical corner post 12 by bushings.

In some example embodiments container 1 may include one or more lift ports 31, such as holes configured to receive tines of a fork lift or other grappling equipment. The lift ports 31 may be mounted on, or integral to, lower rails 20. In an example embodiment, lift ports 31 may be a generally rectangular penetration through lower rails 20 from a first side wall to a second opposing side wall of each lower rail 20.

Further, in some embodiments, container 1 may comprise a sump. For example, the sump may be defined in bottom wall 4 in some embodiments, and thus may be "built-in." In this regard, the sump may comprise a portion of bottom wall 4 that is sloped downward from the surface of bottom wall 4 in one or more directions in a manner that allows liquid to collect or pool within the sump up to the level of bottom wall 4 and/or to the sealing gasket on the container frame. In some embodiments, bottom wall 4 may be sloped away from any and/or all of longitudinal walls 2 and first and second end walls 8, 10, toward a point or surface below the surface of bottom wall 2. Thus, for example, the sump may be similar to the sump shown in partial cross-section in FIGS. 4-7 of U.S. Pat. No. 9,669,748, the entire disclosure of which is incorporated by reference herein for all purposes. Alternatively, in other embodiments, the sump may be analogous to the sump shown and described in U.S. Pat. No. 7,789,256, the entire disclosure of which is also incorporated by reference herein for all purposes.

The sump may be dimensioned such that the length, width, and depth of the sump allows the sump to collect a desired volume of liquid before overflowing. For example, in some embodiments, the sump may be able to collect approximately 83 gallons of liquid, though smaller sumps can be provided in other embodiments. The sump may be formed by cutting a flat rectangular sheet of steel to define opposing "wings" on the four sides thereof, each of which may be bent upwards to meet its adjoining wing. The wings then may be welded together to define the sump walls. In some embodiments, the wings may be radiused such that, when joined with the other wings, the sump walls are upwardly curved. In some embodiments, the sump may resemble a pan or tray.

Those of skill in the art are familiar with various aspects of the construction of intermodal containers. Additional information regarding intermodal containers is provided in U.S. Pat. Nos. 9,669,748; 7,789,256; 7,306,110; 7,240,936; 6,796,452; and 6,364,154. The entire disclosures of each of these patents is incorporated herein by reference for all purposes.

Figure 2:
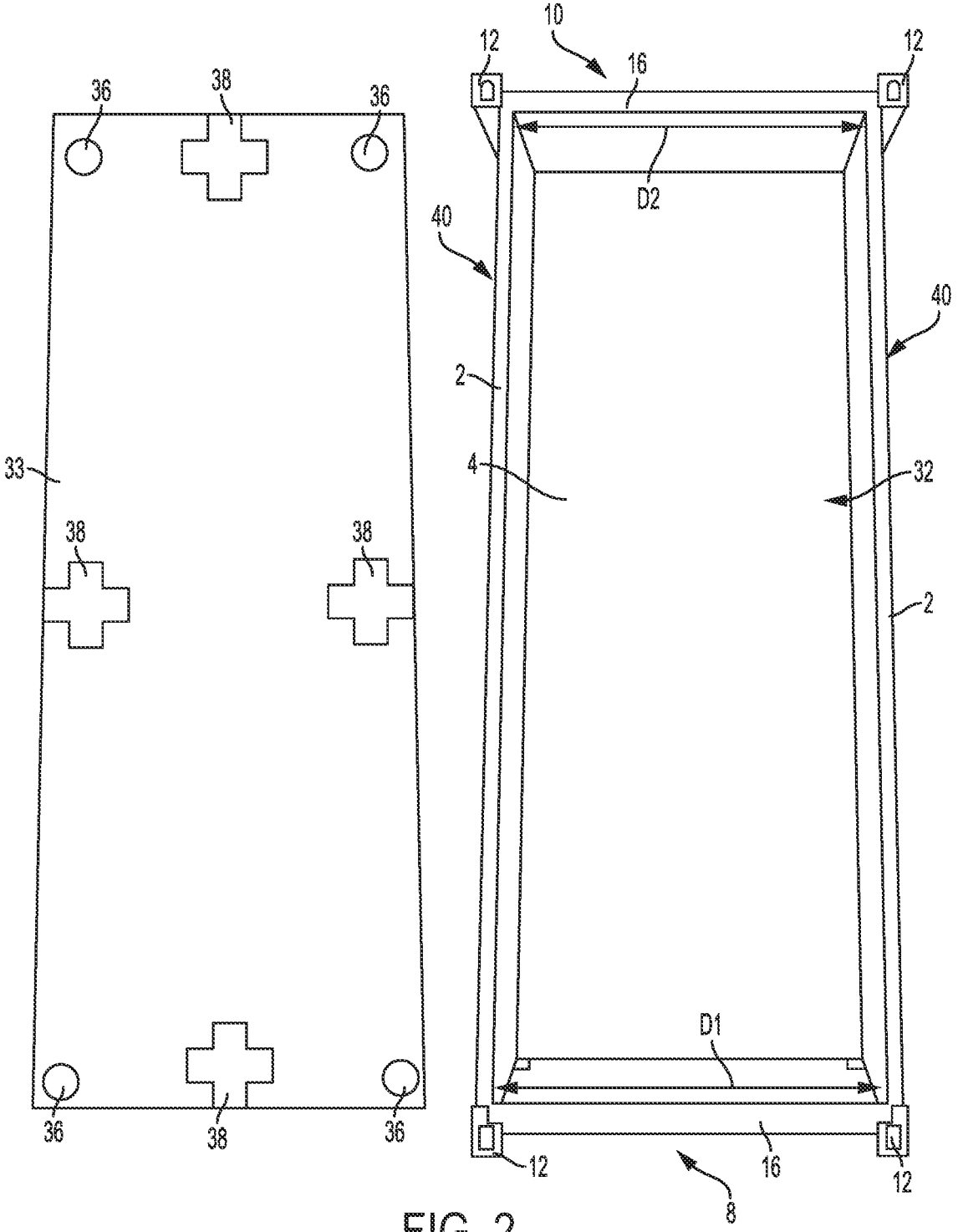
FIG. 2 is a top plan view of a container constructed in accordance with an embodiment of the present invention, wherein the upper rails and lid are not shown in order to facilitate discussion of the container's construction.

FIG. 2 is a top plan view of a container and a lid in accordance with an embodiment of the present invention. The container illustrated in FIG. 2 is analogous in some respects to container 1 of FIG. 1, and therefore like numbers are used to denote like components. Turning to FIG. 2, a container 1 and a lid 33 are depicted. Lid 33 may be sized to close a top opening 32 for loading or unloading of material through top wall 6 of container 1. Lid 33 may be formed of the same material of the container walls or may be formed of other suitable materials. In some example embodiments, lid 33 may include one or more rigging fittings, such as pad eyes 36 to enable movement of lid 33 between an open, or removed, position to a shut, or installed, position, as the case may be. Further, one of more closure mechanisms 38 may be provided on lid 33 or upper rails 18 to facilitated closure of the lid 33 and securing of lid 33 to container 1. Closure mechanisms 38 may be substantially similar to the closure mechanisms 26, described above, or another suitable mechanism familiar to those skilled in the art may be used.

Turning back to container 1, in the illustrated embodiment, longitudinal walls 2 extend between the first end wall 8 and the second end wall 10 and are flared such that distance between the first longitudinal wall and the second longitudinal wall is widest proximate to an opening disposed at the first end wall 8. When viewed from above as in FIG. 2, walls 2, 8, and 10 may define a truncated pyramidal shape. For instance, a first distance D1 between the first longitudinal wall and the second longitudinal wall proximate to the first end wall 8 is greater than a second distance D2 between the first longitudinal wall and the second longitudinal wall proximate to the second end wall 10 in this embodiment. The difference between first distance D1 and second distance D2 may be 0.5 inches, 1 inch, 2 inches, 4 inches, or the like, or it may be greater in some embodiments. In some example embodiments, the difference between first distance D1 and second distance D2 may be selected so that container 1 complies with the interior dimension requirements of ISO 668.

Figure 3:
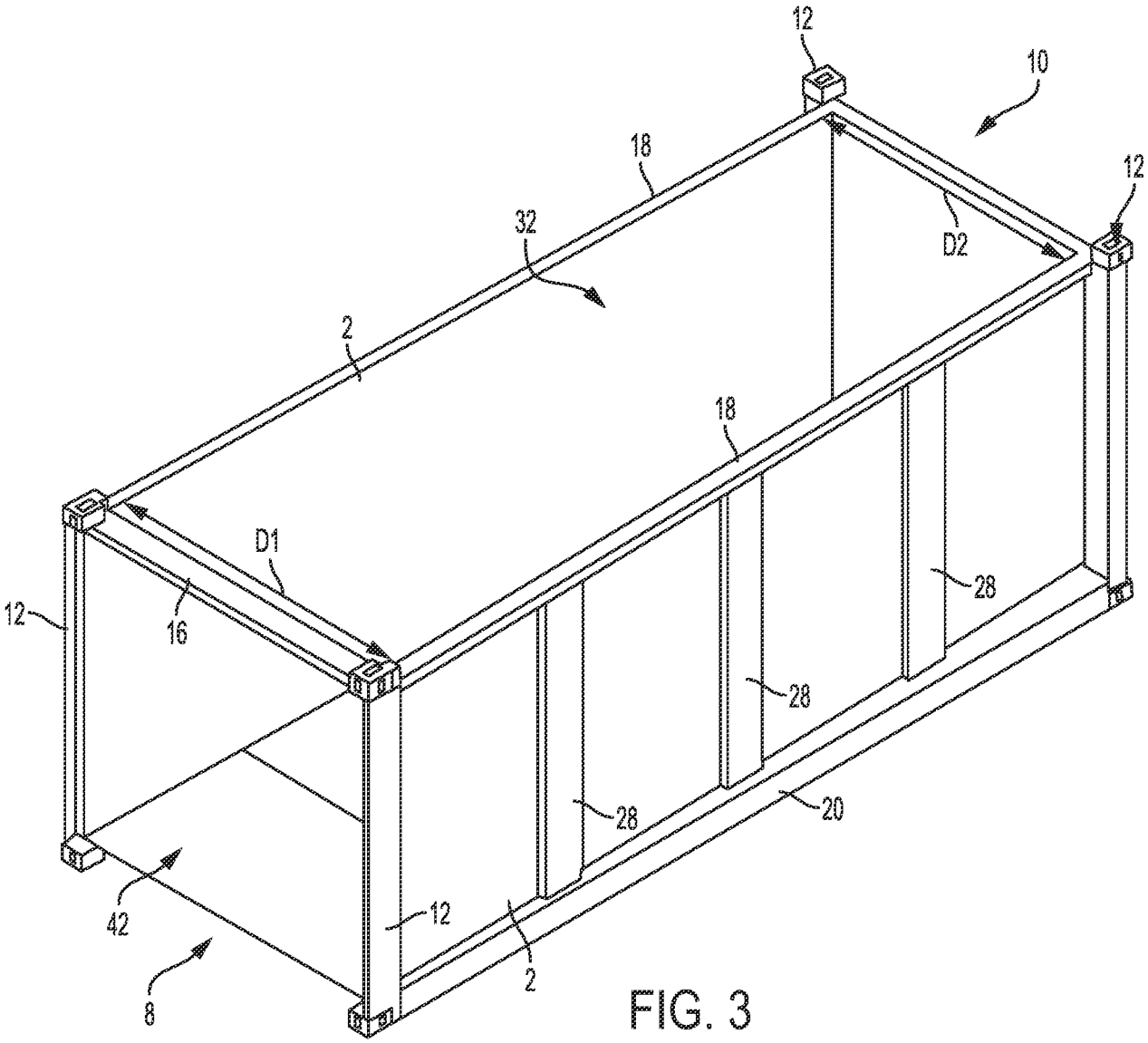
FIG. 3 is a perspective view of the container of FIG. 2, wherein the lid and swing door are not shown in order to facilitate discussion of the container's construction.
Figure 4:
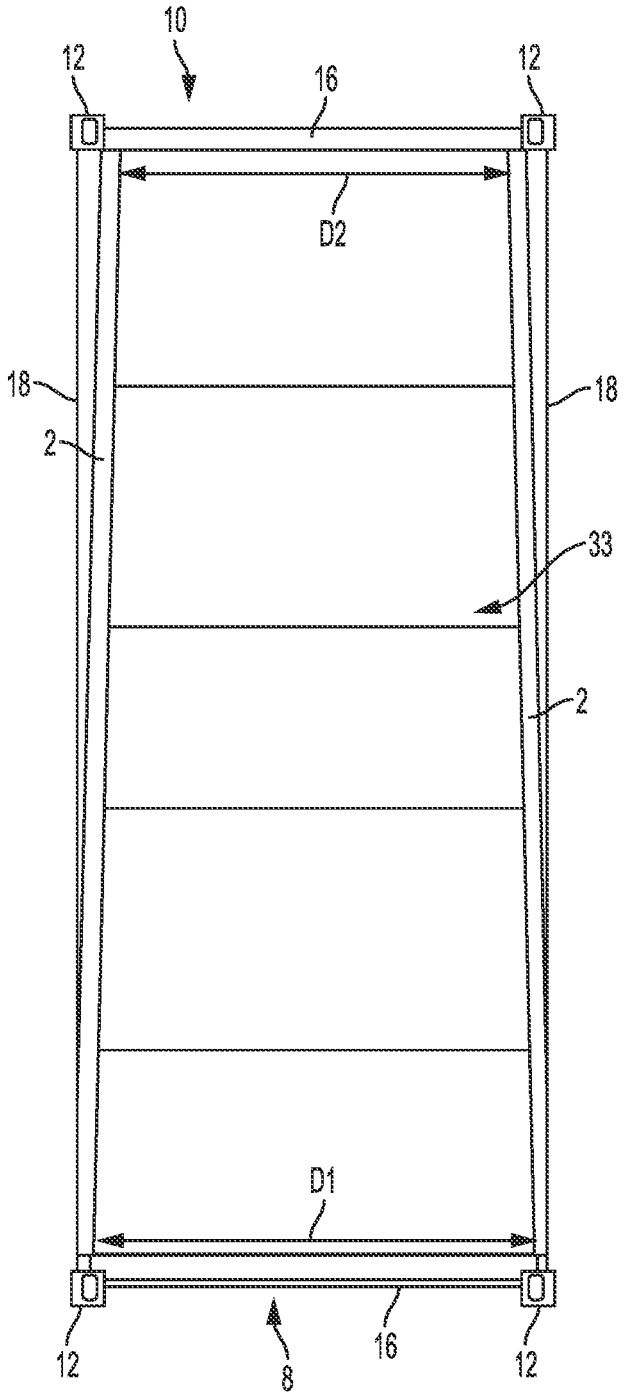
FIG. 4 is an example top plan view of the container of FIG. 2.

Referring also to FIGS. 3 and 4, which are partial perspective and top plan views of container 1, respectively, swing door 22 may close a front opening 42, and the frame may include one or more side rail posts 28 disposed between the upper rails 18 and the lower rails 20. Side rail posts 28 may be welded or otherwise affixed to the upper rails 18 and lower rails to provide vertical support to the frame along upper rails 18 and lower rails 20 during stacking operations, craning operations, loading operations, or the like. In an example embodiment, side rail posts 28 are disposed on the exterior face 40 of longitudinal walls. In FIG. 4, lid 33 is shown installed and covering top opening 32.

Based on the foregoing, in embodiments of the invention, because longitudinal walls 2 may be angled inward as the distance increases away from an end of container 1 that is open (or can be opened), the material carried in container 1 may release from and/or not adhere to longitudinal walls 2 during dumping of the material from container 1 out of the opening. In various embodiments, the movement of the material relative to longitudinal walls 2 is due to the distance between the first longitudinal wall and the second longitudinal wall increasing as proximity to the opening in first end wall 8 increases. In other words, the container body may define a greater internal cross-sectional area as the material moves toward the opening, causing a decrease in the pressure applied to longitudinal walls 2 and a decrease in friction between the material and longitudinal walls 2. The decrease in friction may reduce the erosion of longitudinal walls 2 caused by the sliding of the material out of container 1. The reduction in erosion enables paint or other protective coatings on longitudinal walls 2 to last longer, reducing corrosion of longitudinal walls 2. Additionally, the decrease in friction may reduce erosion of steel forming longitudinal side walls 2 in the absence of a protective coating or after the protective coating has been eroded.

Notably, although longitudinal walls 2 may be flared as discussed above, in preferred embodiments some or all components of the frame, such as but not limited to the upper rails 18 and lower rails 20, may nonetheless have a rectilinear construction, which may be compliant with ISO 668. The rectilinear construction of the frame as shown allows intermodal fittings 30 to maintain specified spacing to enable stacking, mounting, and transport of container 1. Further, the container body may be tapered from the opening in first end wall 8 to second end wall 10 within the interior dimension requirements of ISO 668.

Those of skill in the art will appreciate that, although in some embodiments longitudinal walls 2 may be substantially planar in shape, in other embodiments they may define other shapes while still being flared as described herein. For instance, longitudinal walls 2 may be curved outward or inward in some embodiments, and in yet other embodiments longitudinal walls 2 may define a "stepped" configuration when viewed from above. In still other embodiments, one longitudinal wall 2 may have a different shape or configuration than the other longitudinal wall 2. In these examples, however, the width between longitudinal walls 2 may be greater at an end proximate an opening of container 1 than the width between longitudinal walls 2 at the opposing end of container 1. Additionally, while longitudinal walls 2 may preferably be disposed perpendicularly to top wall 6 and bottom wall 4, they may also be disposed at an angle to top wall 6 and/or bottom wall 4 in other embodiments.

In some example embodiments, an external face 40 of each of the first longitudinal wall and the second longitudinal wall is flush, or substantially flush, with a respective exterior side face of the vertical corner post 12 of the front frame and is flush, or substantially flush, with a respective interior side face of the vertical corner post 12 of the rear frame. However, other embodiments are also within the scope of the present invention. For instance, in some embodiments, only one longitudinal wall 2 may be flared. In some embodiments, the body of container 1 need not be tapered along its entire length, and it may instead be tapered only along a portion thereof while other portion(s) of the container body are not tapered. In still other embodiments, longitudinal walls 2 may extend parallel with rails 18, 20 such that container 1 appears rectilinear in shape when viewed from the exterior, but walls 2 may themselves be tapered such that the walls are narrower near one end of container 1 and increase in width as the walls extend toward the other end of container 1. Further, the tapering of the container body as described herein could also be accomplished with one or more of bottom wall 4 and top wall 6, rather than longitudinal walls 2. Those of skill in the art will appreciate that still other embodiments are contemplated.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. An intermodal transport container, comprising:

a frame comprising:

a front frame and a rear frame, each of the front frame and rear frame comprising two vertical corner posts interconnected by a lower crossmember and an upper crossmember; and a set of lower rails and a set of upper rails extending between the front frame and the rear frame defining upper and lower longitudinal corner edges of the container; and a body comprising a plurality of container walls defining a cargo receiving space, each of the container walls being supported by the frame, wherein the plurality of container walls comprises a bottom, a first longitudinal wall, a second longitudinal wall, a first end wall, and a second end wall;

wherein the first longitudinal wall and the second longitudinal wall are flared, such that distance between the first longitudinal wall and the second longitudinal wall is widest proximate to an opening disposed at the first end wall;

wherein an external face of the first longitudinal wall and the second longitudinal wall is flush with an exterior side face of the vertical corner post of the front frame and is flush with an interior side face of the vertical corner post of the rear frame.

2. The transport container of claim 1, wherein the first longitudinal wall and the second longitudinal wall extend between the first end wall and the second end wall and a first distance between the first longitudinal wall and the second longitudinal wall proximate to the first end wall is greater than a second distance between the first longitudinal wall and the second longitudinal wall proximate to the second end wall.

3. The transport container of claim 2, wherein the first longitudinal wall and the second longitudinal wall are generally planar in shape.

4. The transport container of claim 1, wherein the frame further comprises two or more side rail posts disposed between the set of upper rails and set of lower rails.

5. The transport container of claim 4, wherein the two or more side rail posts are disposed on an exterior face of the first longitudinal wall and the second longitudinal wall.

6. The transport container of claim 1 further comprising: intermodal fittings disposed at each corner of the container.

7. The transport container of claim 6, wherein the frame, intermodal fittings, and cargo receiving space comply with ISO 668 as published in August 2013.

8. The transport container of claim 1, wherein the plurality of container walls are formed of corrosion resistant steel.

9. The transport container of claim 1, wherein the first longitudinal wall, the second longitudinal wall, the first end wall, and the second end wall are disposed perpendicularly to the bottom.

10. The transport container of claim 1, wherein the first end wall comprises a swing door coupled with the front frame.

11. An intermodal transport container comprising:

a frame comprising:

a front frame and a rear frame, each of the front frame and rear frame comprising two vertical corner posts interconnected by a lower crossmember and an upper crossmember; and a set of lower rails and a set of upper rails extending between the front frame and the rear frame defining upper and lower longitudinal corner edges of the container; and a body comprising a plurality of container walls defining a cargo receiving space, each of the container walls being supported by the frame, wherein the plurality of container walls comprises a bottom, a first longitudinal wall, a second longitudinal wall, a first end wall, and a second end wall; and intermodal fittings disposed at each corner of the container, wherein a first distance between the first longitudinal wall and the second longitudinal wall proximate to the first end wall is greater than a second distance between the first longitudinal wall and the second longitudinal wall proximate to the second end wall;

wherein an external face of the first longitudinal wall and the second longitudinal wall is flush with an exterior side face of the vertical corner post of the front frame and is flush with an interior side face of the vertical corner post of the rear frame.

12. The intermodal transport container of claim 11, wherein the first longitudinal wall and the second longitudinal wall are generally planar in shape.

13. The intermodal transport container of claim 11, wherein the frame further comprises two or more side rail posts disposed between the set of upper rails and the set of lower rails.

14. The intermodal transport container of claim 13, wherein the two or more side rail posts are disposed on an exterior face of the first longitudinal wall and the second longitudinal wall.

15. The intermodal transport container of claim 11, wherein the plurality of container walls are formed of corrosion resistant steel.

16. The intermodal transport container of claim 11, wherein the first longitudinal wall, the second longitudinal wall, the first end wall, and the second end wall are disposed perpendicularly to the bottom.

17. The intermodal transport container of claim 11, wherein the first end wall comprises a swing door coupled with the front frame.

18. The intermodal transport container of claim 11, wherein a sump is defined in the bottom of the plurality of container walls.

* * * * *